US008020822B2

(12) United States Patent
Goldin et al.

(10) Patent No.: US 8,020,822 B2
(45) Date of Patent: Sep. 20, 2011

(54) SHELF ASSEMBLY FOR CUSTOMIZABLE FURNITURE

(76) Inventors: Michael Goldin, Berkeley, CA (US); Steven Goldin, Berkeley, CA (US)

( * ) Notice: Subject to any disclaimer, the term of this patent is extended or adjusted under 35 U.S.C. 154(b) by 237 days.

(21) Appl. No.: 12/475,305

(22) Filed: May 29, 2009

(65) Prior Publication Data

US 2009/0294391 A1 Dec. 3, 2009

Related U.S. Application Data

(60) Provisional application No. 61/057,178, filed on May 29, 2008.

(51) Int. Cl.
*A47G 29/02* (2006.01)
*E04G 5/06* (2006.01)

(52) U.S. Cl. ..... 248/250; 248/223.41; 211/183; 211/184; 108/147.17

(58) Field of Classification Search ..... 211/43, 211/133.4, 133.6, 134, 135, 182, 184, 183, 211/186; 248/223.41, 241, 242, 250; 108/108, 108/147.17, 157.13, 180; 312/351, 408; 403/331, 381, 397
See application file for complete search history.

(56) References Cited

U.S. PATENT DOCUMENTS 1,511,704 A * 10/1924 Buck ..... 24/326
2,746,661 A * 5/1956 Kaplan ..... 224/551
3,132,832 A * 5/1964 Kore, Jr. ..... 248/307
4,065,088 A * 12/1977 Shell ..... 248/242
4,460,141 A * 7/1984 Svensson ..... 248/222.13
4,559,879 A * 12/1985 Hausser ..... 108/136
4,786,022 A * 11/1988 Grieshaber ..... 248/287.1
4,903,928 A * 2/1990 Shell ..... 248/223.41
5,023,755 A * 6/1991 Rosenberg ..... 362/12
5,154,449 A * 10/1992 Suei-Long ..... 285/298
6,113,042 A * 9/2000 Welsch et al. ..... 248/218.4
7,066,549 B2 * 6/2006 Dennon et al. ..... 297/440.2
7,086,633 B2 * 8/2006 Welch et al. ..... 248/218.4
2008/0035592 A1 * 2/2008 Yang et al. ..... 211/119.009

* cited by examiner

*Primary Examiner* — Darnell M Jayne
*Assistant Examiner* — Joshua Rodden
(74) *Attorney, Agent, or Firm* — Brian Beverly; Beeson Skinner Beverly, LLP

(57) ABSTRACT

An adjustable shelf assembly having a plurality of ribs, a rib cam associated with each rib, and a support beam having a substantially I-shaped profile. The rib cam has a transversely extending slot including a floor. Each rib has a shelf-retaining surface, a T-shaped downwardly-opening aperture, and two inwardly extending opposing rib cam flanges. The beam has two upper beam flanges and two annular channels. The upper beam flanges slide into the upper recesses of the aperture such that the rib is captured on the beam, and each rib cam flange extends into a respective one of the channels. The rib cam slides into one of the channels with one of the rib cam flanges captured in the slot. In the channel, the rib cam is rotatable around its longitudinal axis between an unlocked position and a locked position in which the slot floor bears down on the rib cam flange thereby locking the flange to the support beam.

1 Claim, 12 Drawing Sheets

SHELF ASSEMBLY FOR CUSTOMIZABLE FURNITURE

CROSS-REFERENCE TO RELATED APPLICATION

This application claims the benefit of U.S. Provisional Application No. 61/057,178, filed May 29, 2008.

FIELD OF THE INVENTION

This invention is directed to customizable furniture and in particular to an improved shelf assembly used in the construction of such furniture for providing a high degree of strength and versatility in the furniture product.

DESCRIPTION OF THE ILLUSTRATED EMBODIMENT

Figure 1:
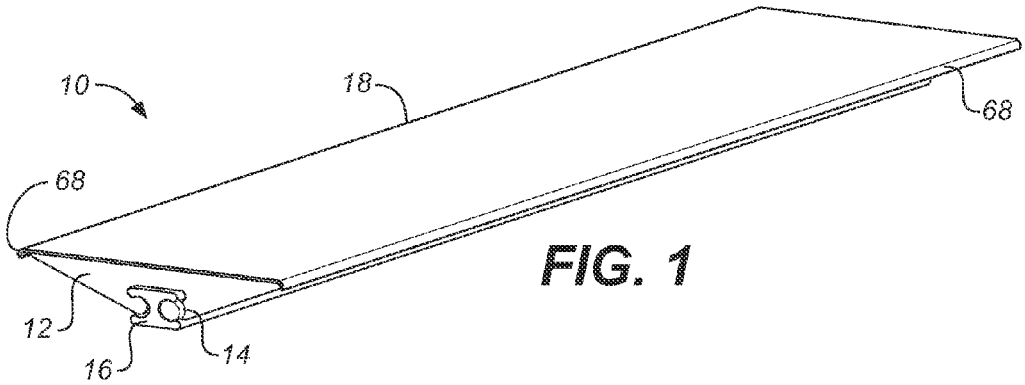
FIG. 1 is an upper perspective view of a shelf assembly according to the invention.
Figure 2:
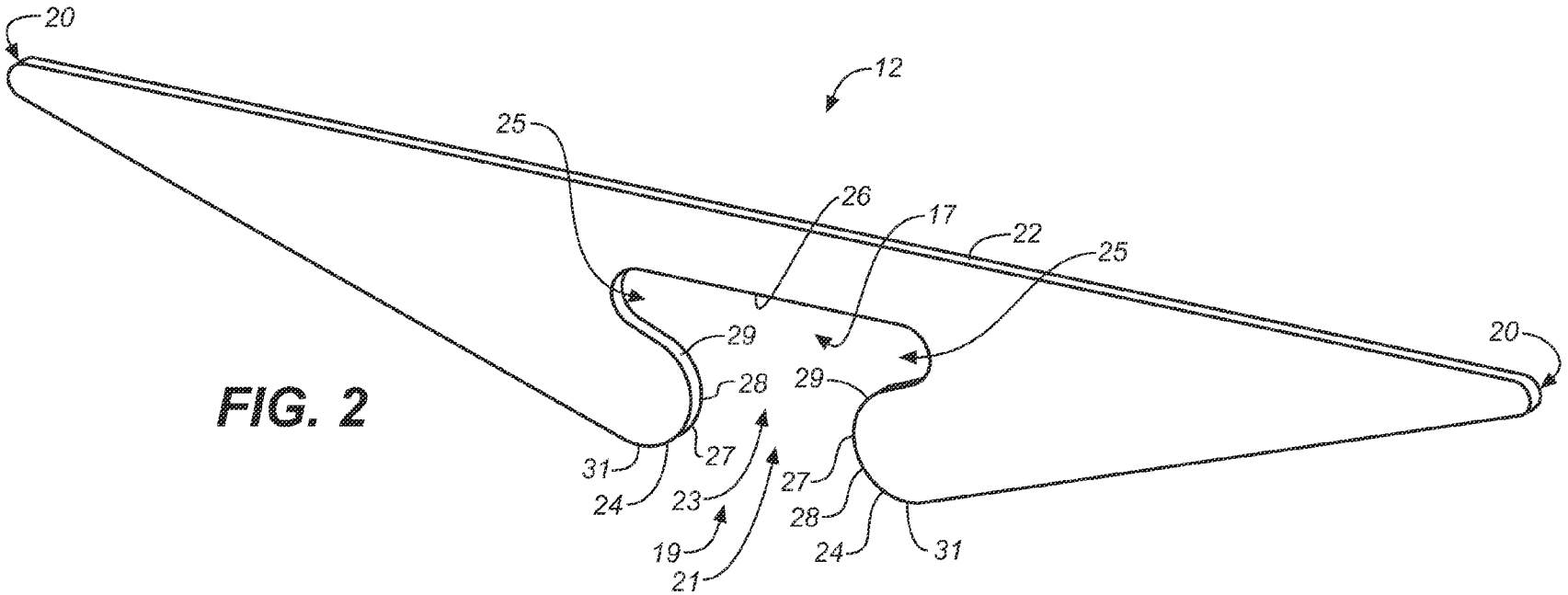
FIG. 2 is an upper perspective view of the rib element of the shelf assembly shown in FIG. 1.
Figure 8A:
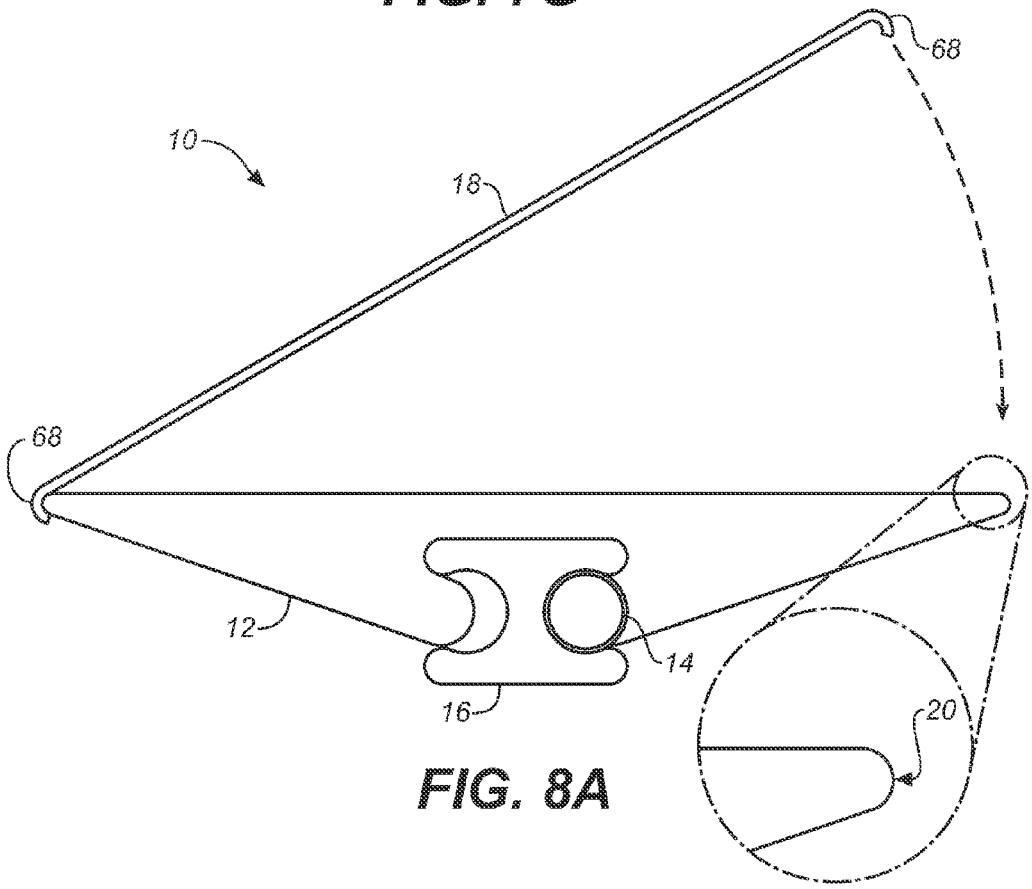
FIG. 8A is an end elevational view of the rib-cam-beam assembly with one curled side edge of the shelf skin positioned around one end of the rib.

A fully configured shelf assembly according to the invention is generally indicated at 10 in FIG. 1. As shown in FIG. 8A, the shelf assembly 10 comprises a rib 12, rib cam 14, beam 16, and shelf skin 18. As shown in FIG. 2, the rib 12 has a substantially triangularly shaped profile. The upper portion of the rib 12 has a flat shelf skin-receiving top surface 22 and two oppositely disposed rounded retaining ends 20. The bottom portion of rib 12 includes a generally T-shaped downwardly opening rib aperture 23 having a neck portion 21 defined by two oppositely facing rib cam flanges 24 that extend inwardly. The aperture 23 has an upper portion 17 and lower portion 19. The upper portion 17 has two opposing upper recesses 25 separated by an upper edge 26 extending there between. The lower portion 19 is laterally bounded by rib cam flanges 24. Each rib cam flange 24 has an arced inner edge 27 including a middle portion 28 in between an upper portion 29 and a lower portion 31.

Figure 3A:
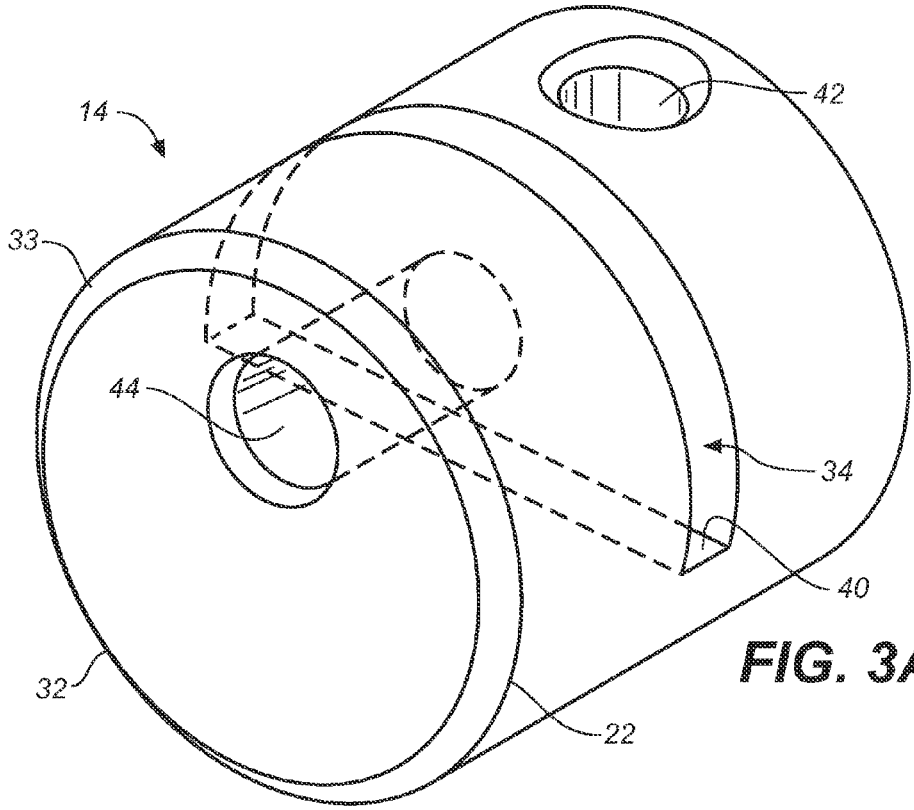
FIG. 3A is a right perspective view of the rib cam element of the shelf assembly shown in FIG. 1.
Figure 3B:
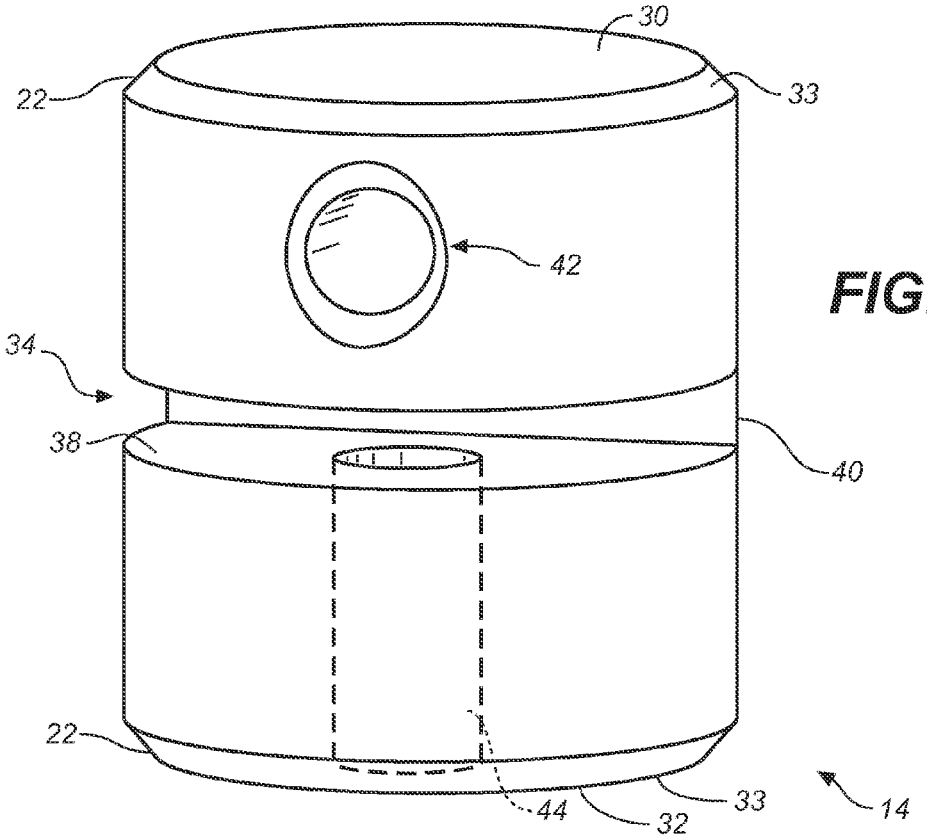
FIG. 3B is a left perspective view of the rib cam shown in FIG. 3A.

Referring now to FIGS. 3A-3B, the rib cam 14 is generally cylindrical in shape having beveled edges 33 surrounding substantially flat first and second ends 30, 32. A semicircular slot 34 disposed in the middle portion of the rib cam 14 extends approximately half way through the rib cam 14 and includes a floor 40 disposed perpendicular to the longitudinal axis of the rib cam 14. A diametrically extending dowel-receiving bore 42 is disposed between slot 34 and first end 30. A threaded hole 44 for receiving a set screw 46 (shown in FIG. 7G) extends from the second end 32 to right slot wall 38.

Figure 4:
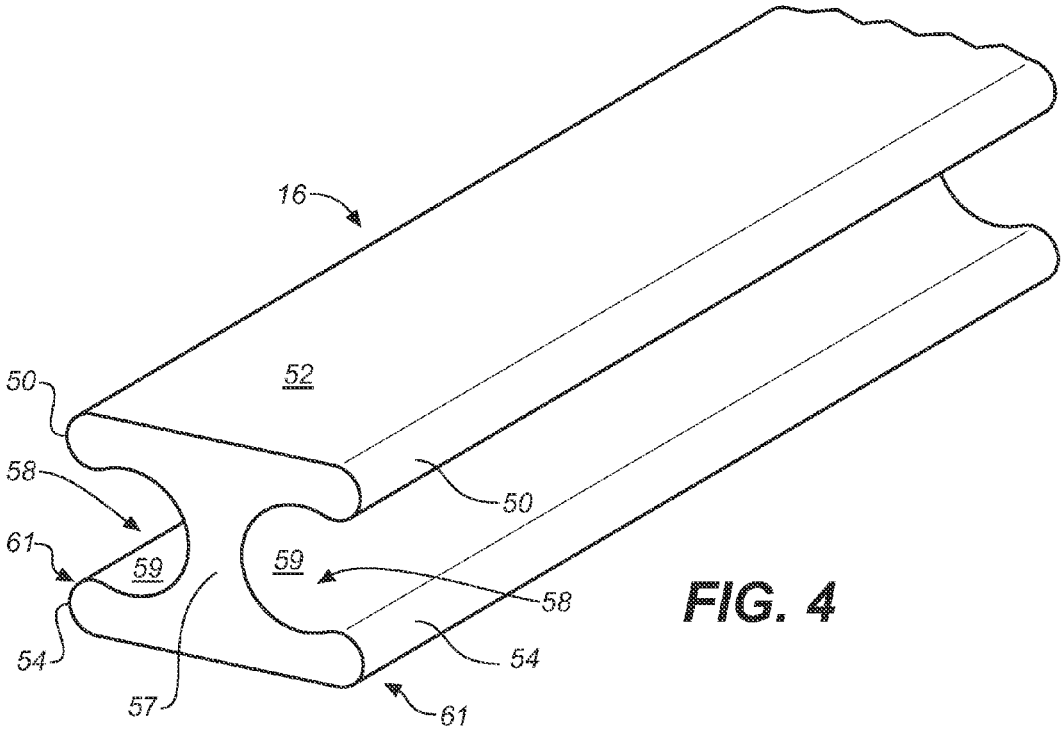
FIG. 4 is an upper perspective view of the beam element of the shelf assembly shown in FIG. 1.

FIG. 4 shows beam 16 as having a generally I-shaped profile. Beam 16 comprises two upper beam flanges 50 collectively having an upper beam flange face 52, two lower beam flanges 54 collectively having a lower beam flange face (not shown), a center web 57, and two oppositely disposed and outwardly facing annular channels 58 between the upper and lower beam flanges 50, 54. Each annular channel 58 has a concave surface 59. Each of the upper and lower beam flanges 50, 54 have rounded lateral edges 61. Each of the two annular channels 58 are sized to hold rib cams 14.

Figures 5A, 5B, 5C:
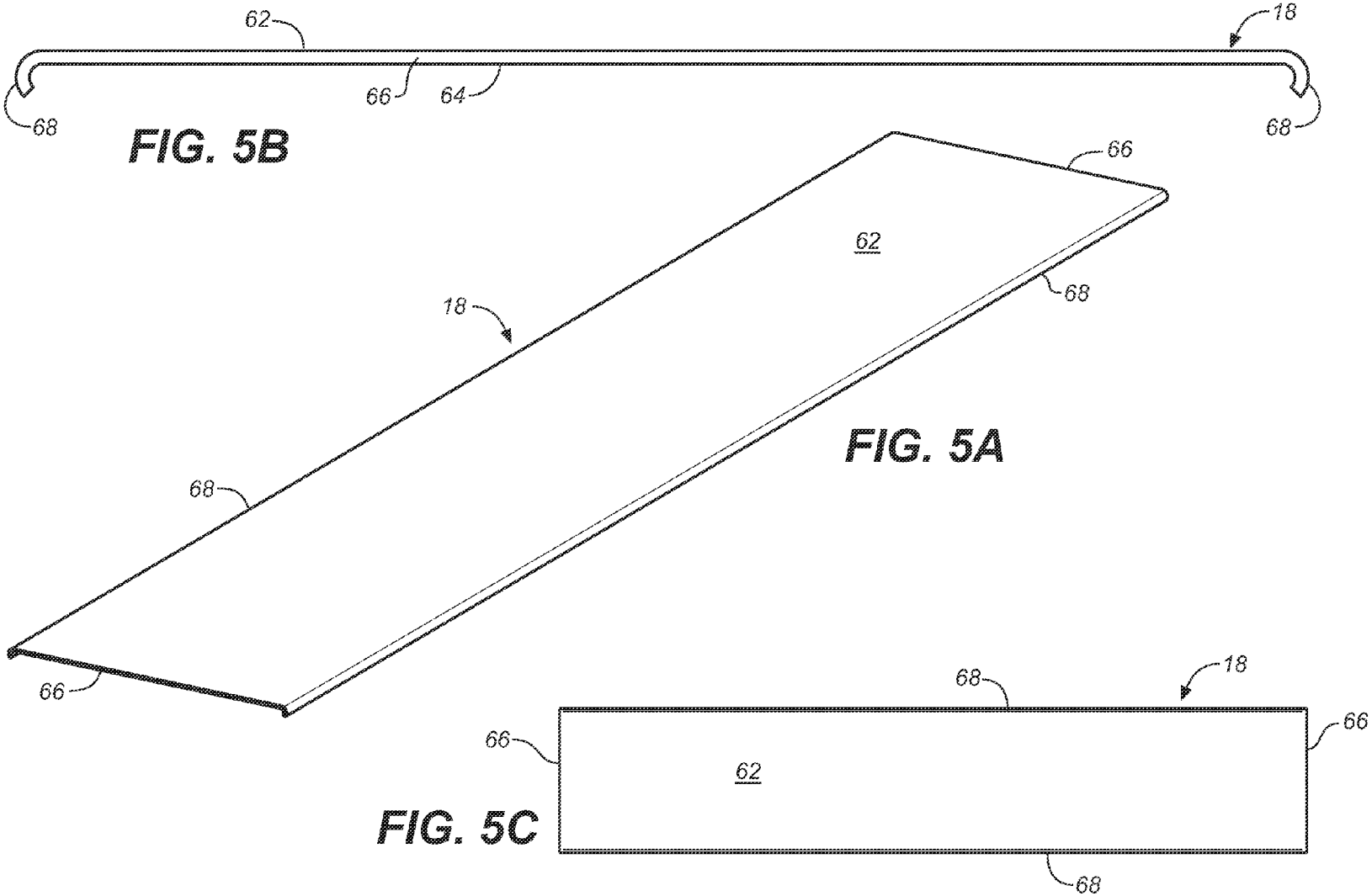
FIG. 5A is an upper perspective view of the shelf skin element of the shelf assembly shown in FIG. 1.
FIG. 5B is an end elevational view of the shelf skin shown in FIG. 5A.
FIG. 5C is a top plan view of the shelf skin shown in FIG. 5A.

Shelf skin 18 comprises an elongated rectangularly shaped flat panel having a top surface 62, a bottom surface 64, two ends 66, and two downwardly curled side edges 68. See FIGS. 5A-5C. The underside of each side edge 68 has a curvature having a radius corresponding to the radius of the curvature of the retaining ends 20 of rib 12 such that the parts fit together snugly as discussed in greater detail below.

Figure 6A:
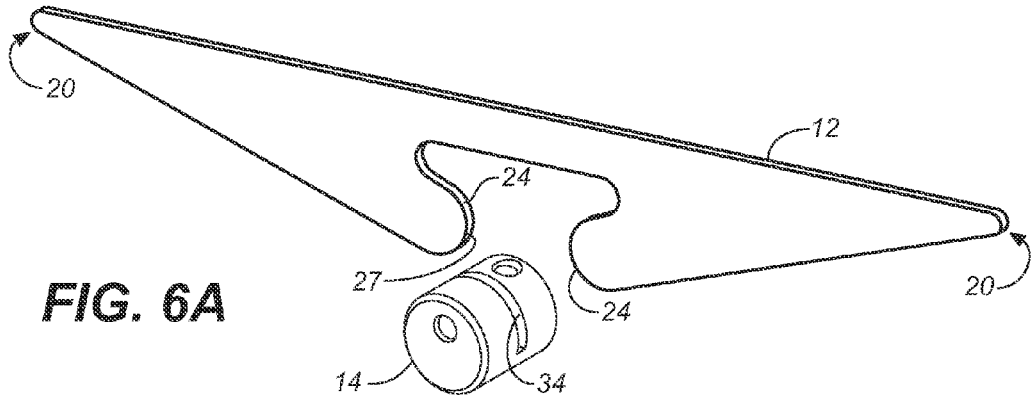
FIG. 6A is an exploded perspective view of a rib and cam assembly of the shelf assembly.
Figure 6B:
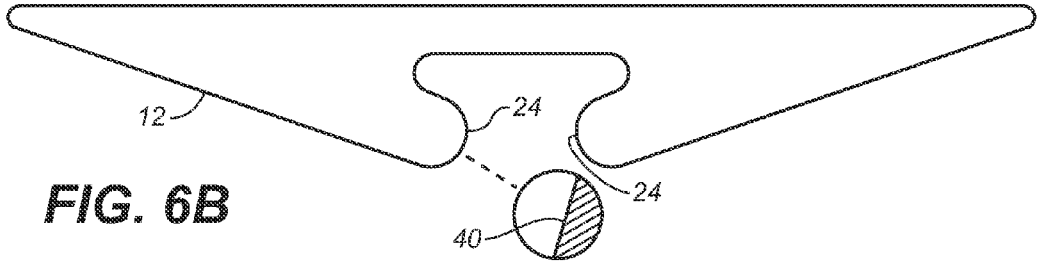
FIG. 6B is an exploded sectional view of a rib and cam assembly formed by assembling the rib and cam elements shown in FIG. 6A.
Figure 6C:
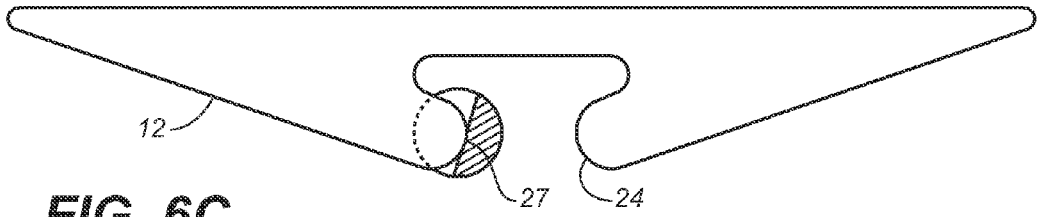
FIG. 6C is a sectional view of the rib and cam assembly of FIG. 6B.
Figure 6D:
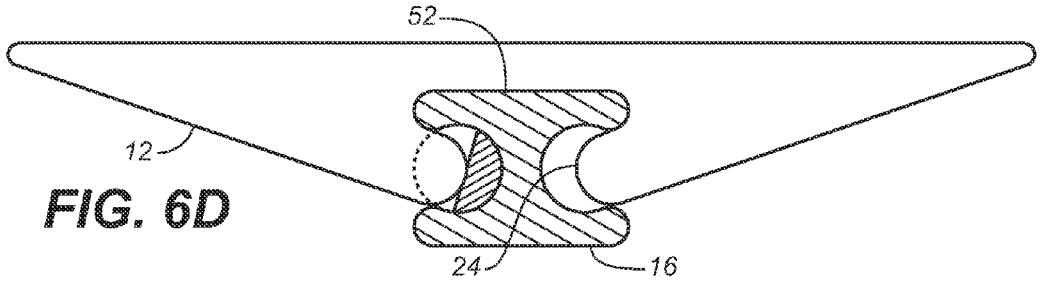
FIG. 6D is a sectional view of the rib and cam assembly of FIG. 6B assembled in position on the beam.
Figure 6E:
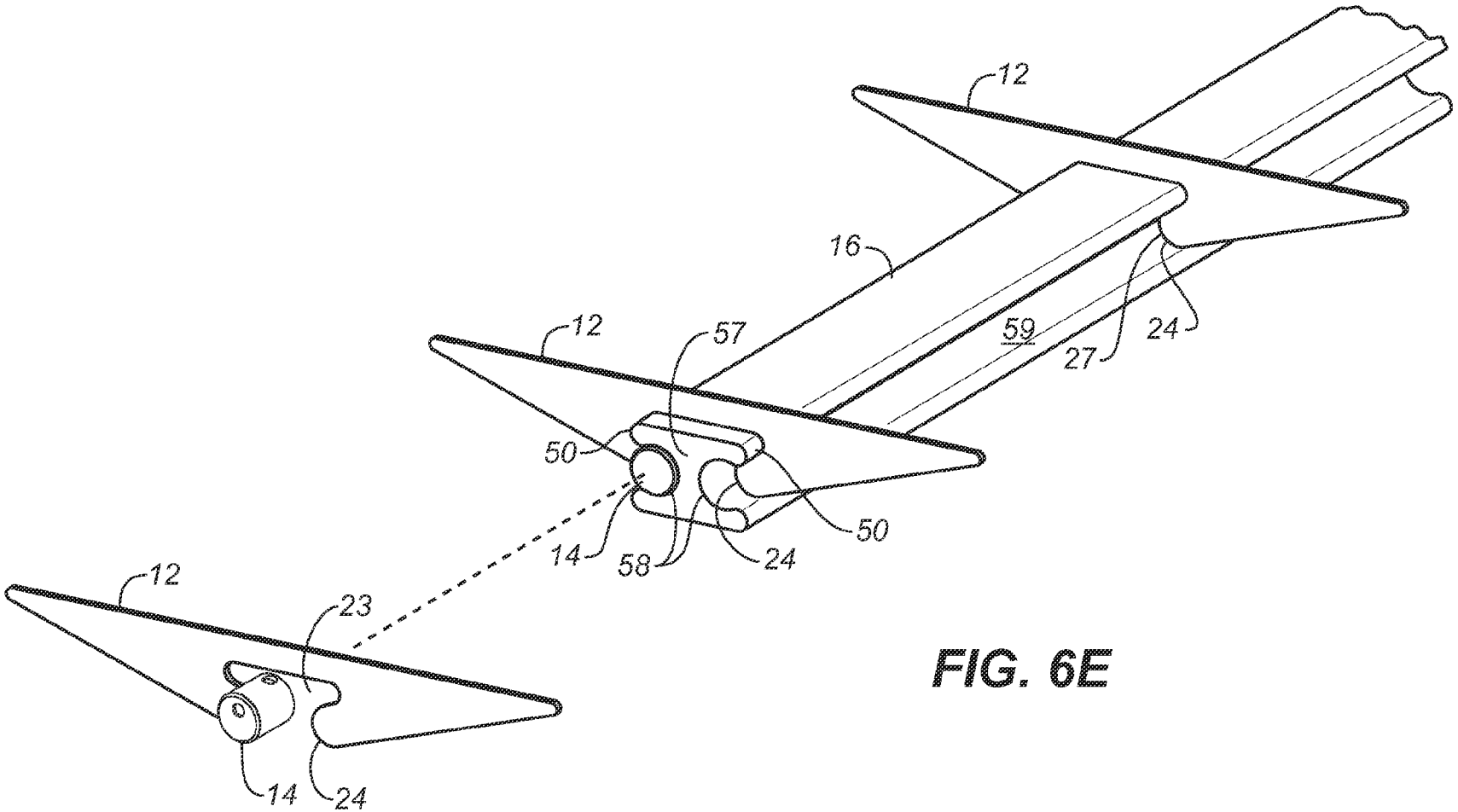
FIG. 6E is an exploded perspective view of two rib and cam assemblies, one in position on the beam and another shown in separated and assembled positions on the beam.

Referring now to FIGS. 6A-6C, the shelf assembly 10 is configured by inserting one of the rib cam flanges 24 of the rib 12 into slot 34 of rib cam 14 such that the middle portion 28 of flange 24 is brought into contact with slot floor 40. Next, as shown in FIGS. 6D-6E, cam 14 is slid into channel 58 of beam 16, following which the upper beam flanges 50 and center web 57 are slid into the upper recesses 25 of rib aperture 23 and simultaneously rib cam flanges 24 are slid part way into channels 58 of beam 16, such that one of the upper beam flanges 50 is oppositely disposed to the rib cam 14. In this arrangement, the upper edge 26 of rib aperture 23 rests on upper beam flange face 52 of beam 16, upper beam flanges 50 are captured in rib aperture 23, and rib cam flanges 24 are partially inserted laterally into channels 58 of beam 16. The arced inner edges 27 of the rib cam flanges 24 and the concave surfaces 59 of the annular channels 58 form crescent-shaped profiles, where the distance between the arced inner edge 27 of the rib cam flanges 24 and the concave surface 59 of the annular channels 58 is greater at the middle portion 28 than the upper and lower portions 29, 31 of the arced inner edge 27.

Figure 7A:
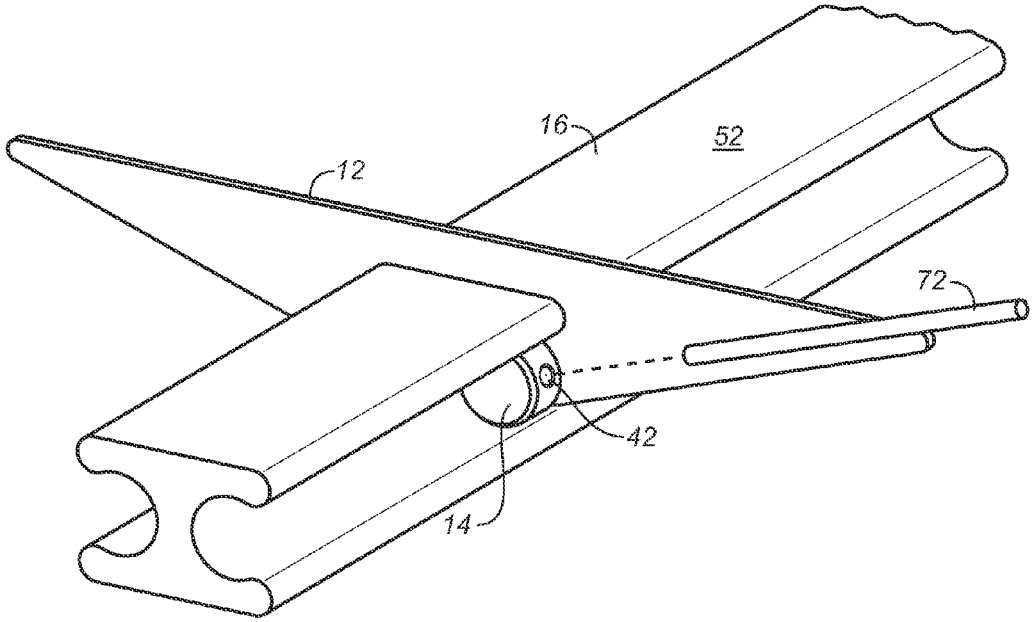
FIG. 7A is an exploded perspective view of a rib-cam-beam assembly and a dowel for rotating the cam.
Figure 7B:
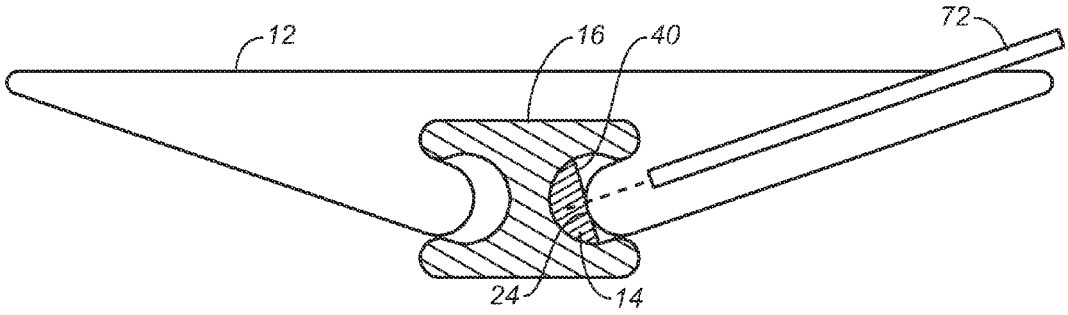
FIG. 7B is a sectional view of the rib-cam-beam assembly and dowel shown in FIG. 7A.
Figure 7C:
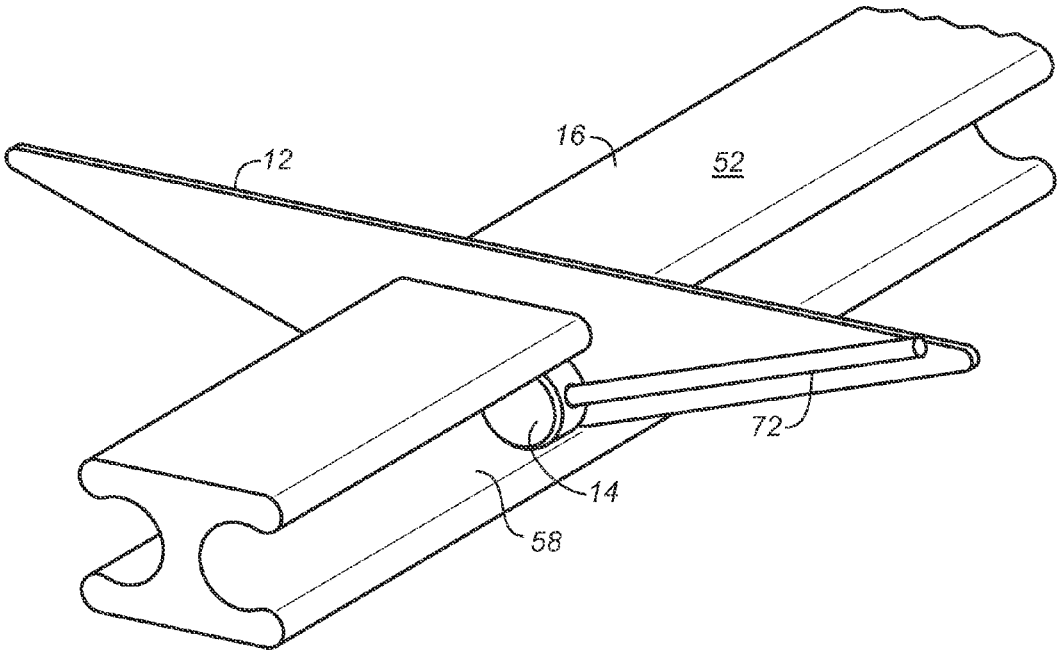
FIG. 7C is an upper perspective view of the rib-cam-beam assembly shown in FIG. 7A with the dowel inserted in the diametrical bore of the cam.
Figure 7D:
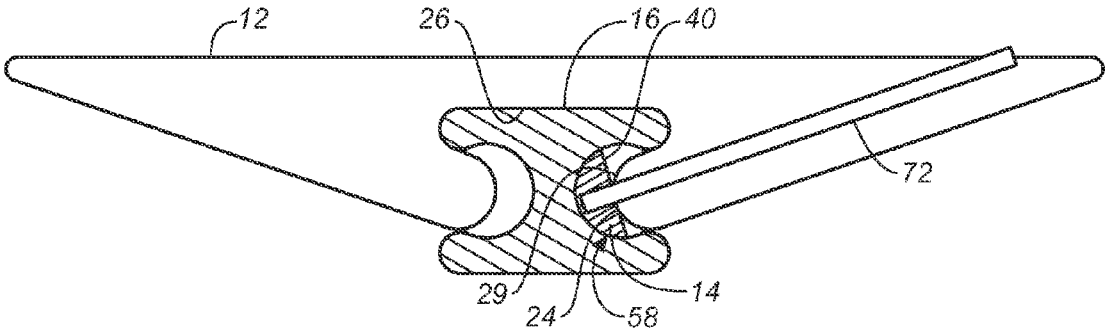
FIG. 7D is a sectional view of the rib-cam-beam assembly and dowel shown in FIG. 7A.
Figure 7E:
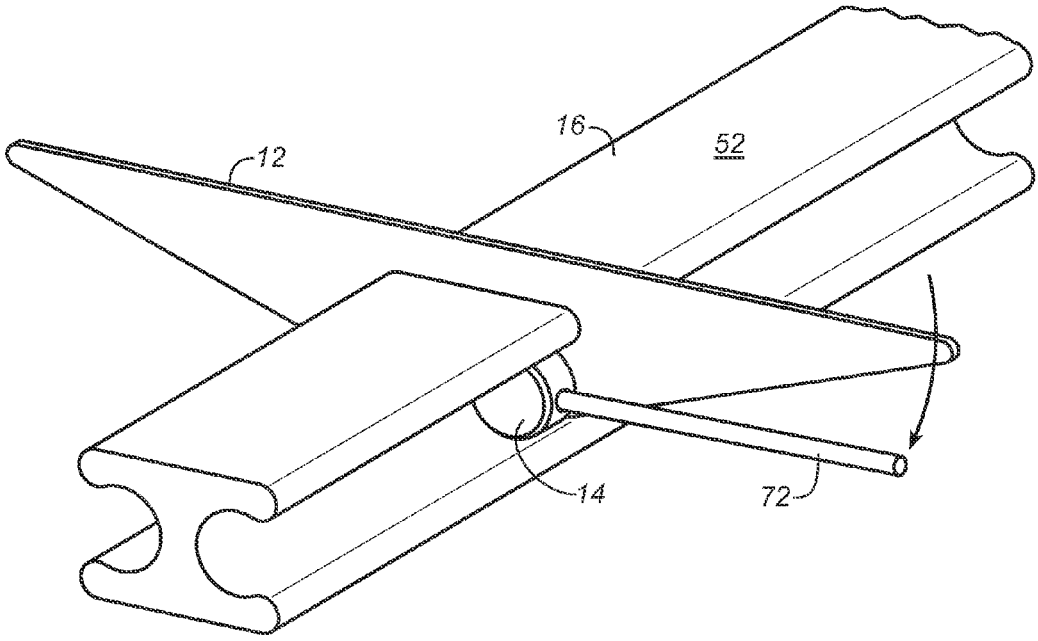
FIG. 7E is an upper perspective view of the rib-cam-beam assembly with the dowel inserted in the diametrical bore of the rib cam shown in FIG. 7C, showing the dowel being pushed in a downward direction.
Figure 7F:
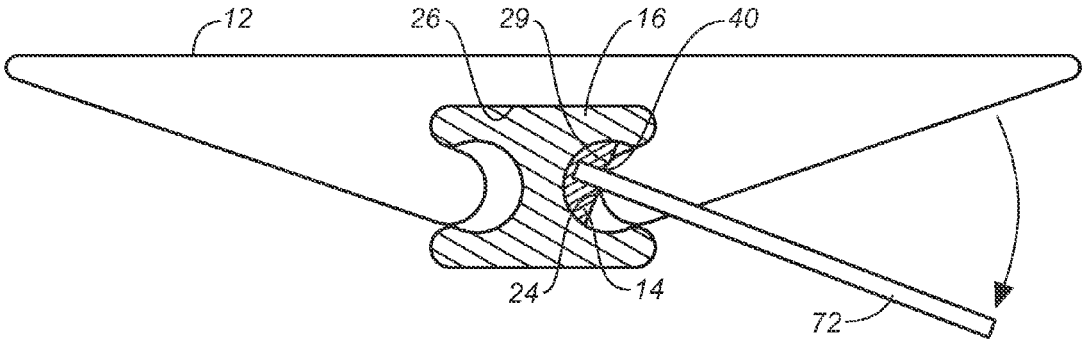
FIG. 7F is a sectional view of the rib-cam-beam assembly and dowel shown in FIG. 7E, showing the dowel pushed further in a downward direction.
Figure 7G:
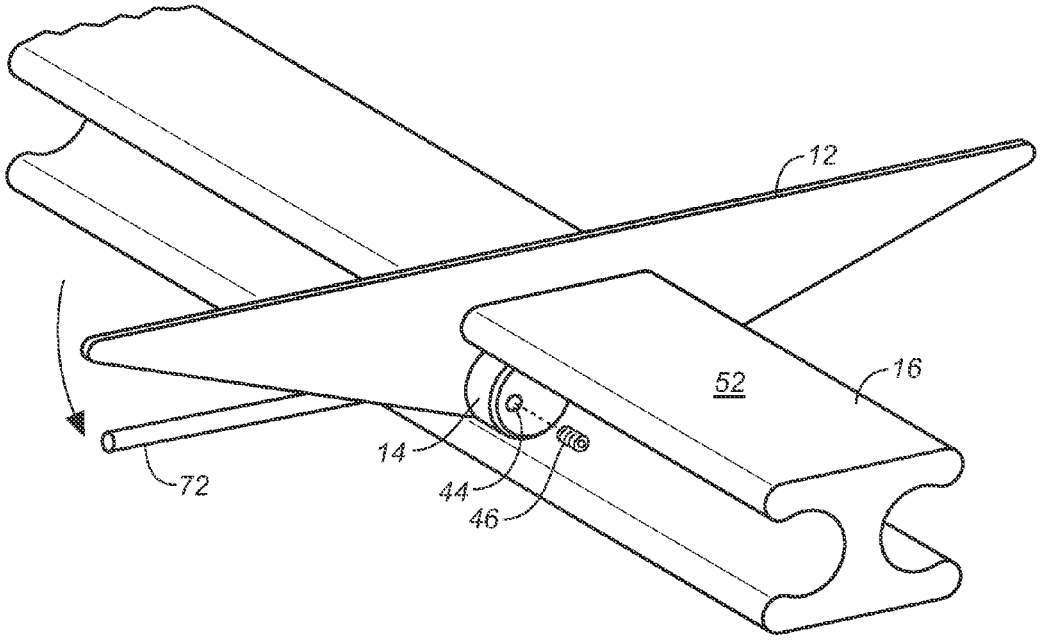
FIG. 7G is an upper perspective view of the rib-cam-beam assembly with the dowel inserted in the diametrical bore of the cam and pushed in a downward direction as shown in FIG. 7E, and a screw for screwing into the threaded hole of the cam.

Disposed in one of the channels 58, the rib cam 14 is rotatable around its longitudinal axis between an unlocked position and a locked position. In an unlocked position, the slot floor 40 of the rib cam 14 tangentially abuts the middle region of the rib cam flange 24. To achieve the locked position, rib 12 is tightened onto beam 16 in a camming process depicted in FIGS. 7A-7G, where the rib cam 14 is rotated into a locked position. Initially a dowel 72 is inserted into bore 42 of the rib cam 14 as shown in FIGS. 7A-7B. Then dowel 72 is pushed in a downward direction to rotate rib cam 14 in channel 58 as shown in FIGS. 7C-7G. With additional reference to FIGS. 2, 3A, 3B and 4, this movement applies a camming action and exerts a downward and outward force on rib 12 by forcing the rotated slot floor 40 of rib cam 14 against the upper portion 29 of the inner edge 27 of the rib cam flange 24, thereby tightening the floor 40 against inner edge 27, pressing the upper edge 26 of the upper portion 17 of the aperture 23 firmly against the upper beam flange face 52 of beam 16, and biasing the upper beam flange 50 disposed opposite rib cam 14 into the corresponding recess 25 of the upper portion 17 of rib aperture 23. A set screw 46 is then threaded into the threaded hole 44 of the rib cam 14 and tightened to retain rib cam 14 in its rotated position relative to rib cam flange 24 to maintain the camming action. This simple camming process instantly and very securely attaches rib 12 to beam 16 at any selected position.

In one aspect of the invention, a rib 12 and cam 14 assembly may be attached to beam 16 at any point along the length of the beam 16 and the position of the assembly can be easily readjusted to meet changing needs. In the illustrated embodiment, a number of rib and cam assemblies may be attached, as described above, to the beam 16 depending upon the anticipated weight load of the shelving system. See FIG. 8B.

Figure 8B:
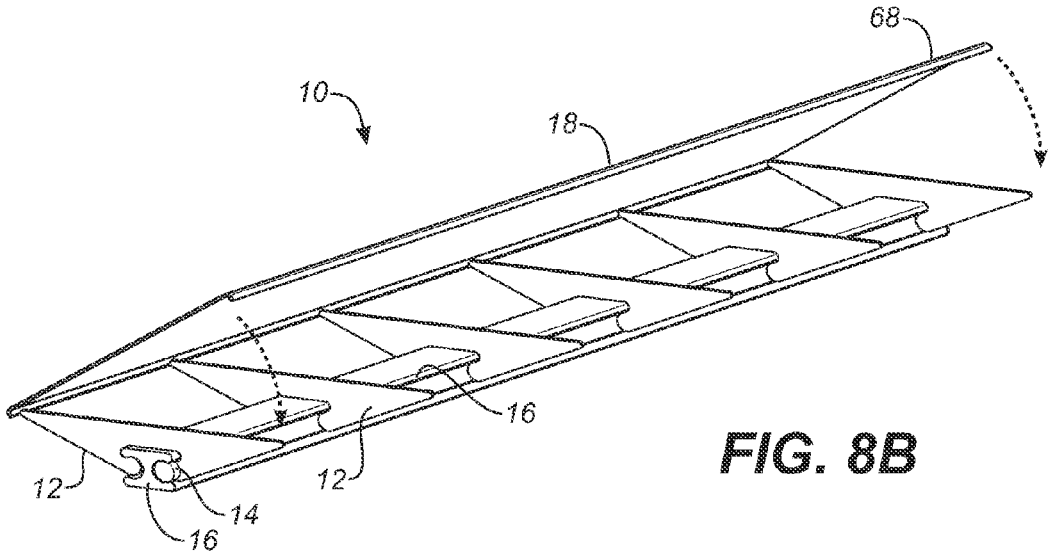
FIG. 8B is an upper perspective view of a plurality of rib and cam assemblies assembled in position on the beam and shelf skin in the position shown in FIG. 8A.
Figure 8C:
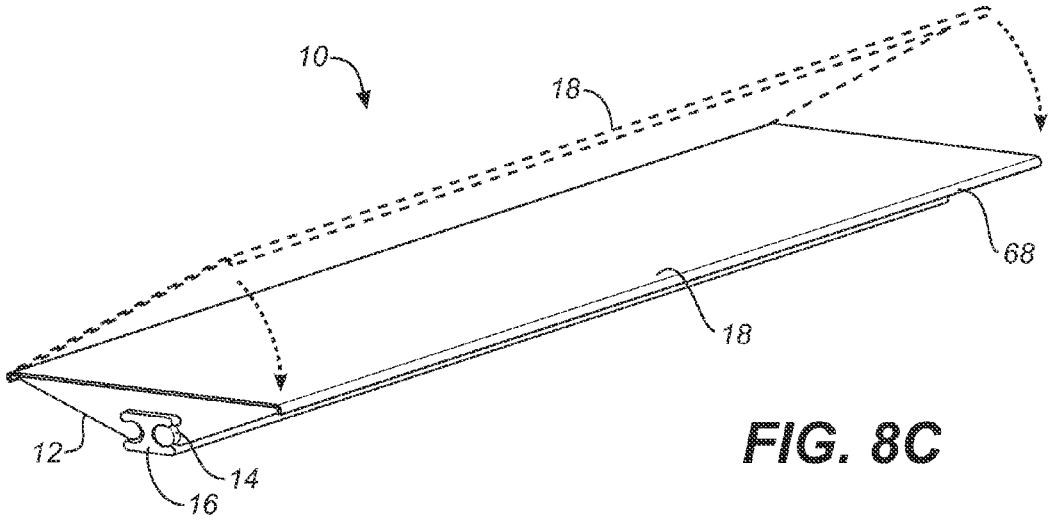
FIG. 8C is another upper perspective view of the rib-cam-beam assembly showing the shelf skin being moved so that the other edge of the shelf skin is positioned just above the other ends of the ribs.
Figure 8D:
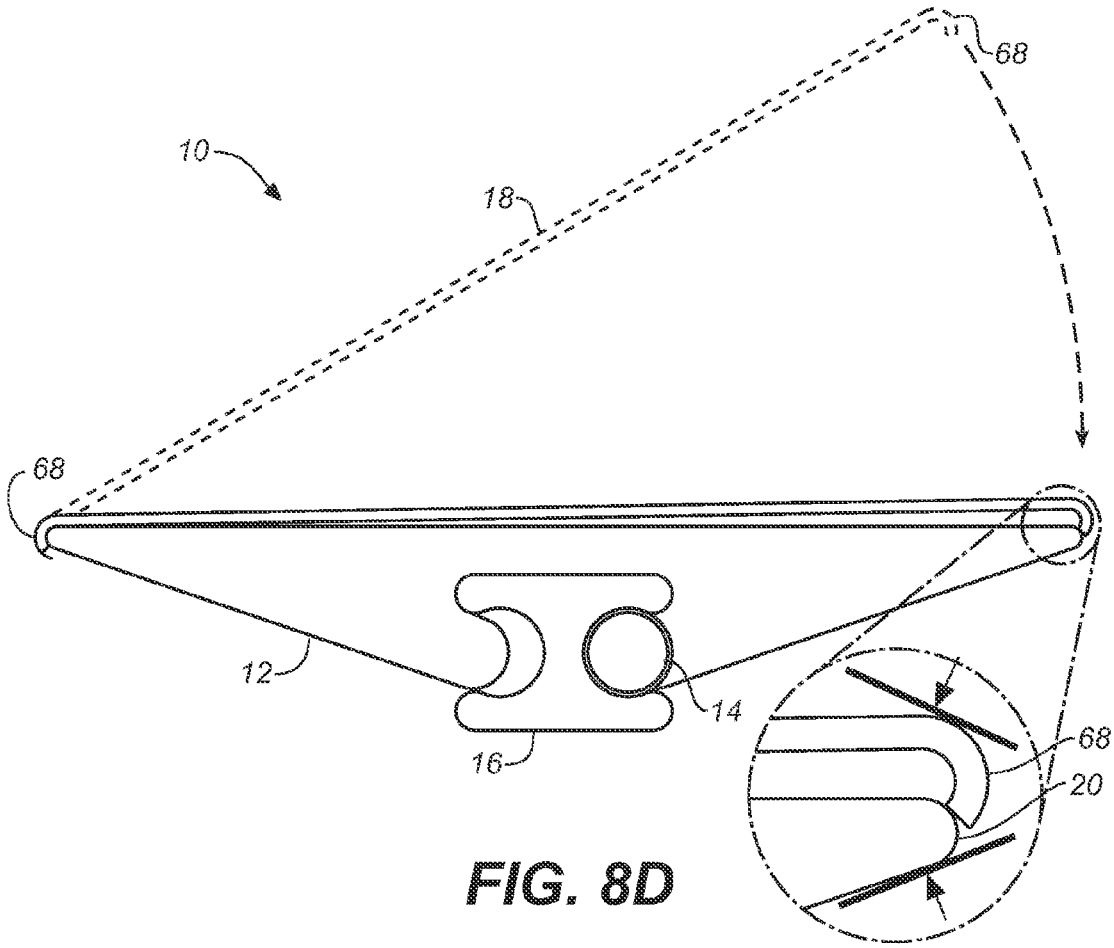
FIG. 8D is an end elevational view of the rib-cam-beam assembly and shelf skin shown in FIG. 8C, with a close-up view of a squeezing tool for snap-fitting the lip of the shelf skin over the end of the rib.
Figure 8E:
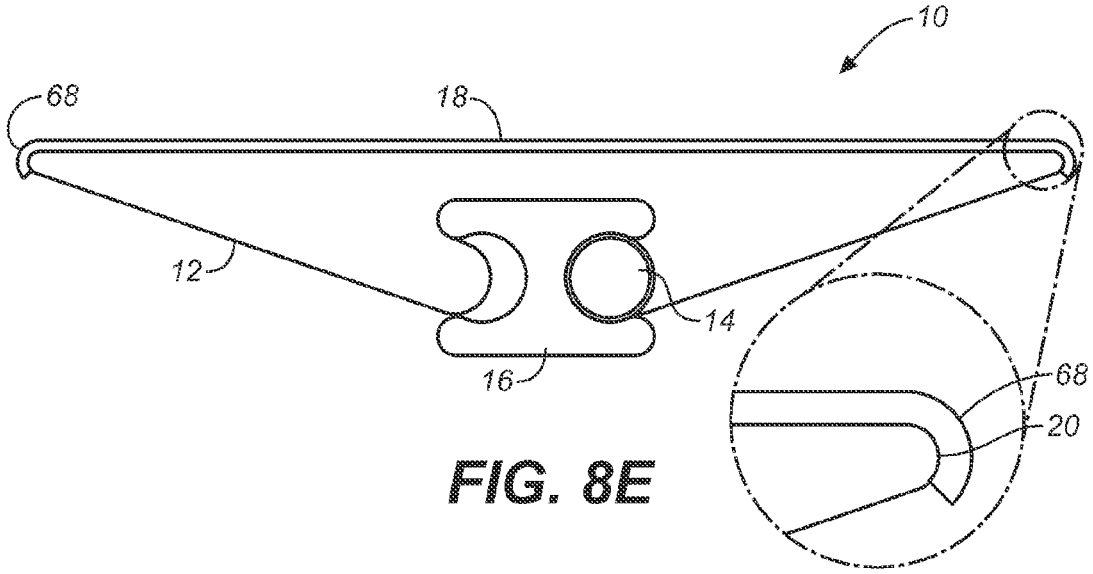
FIG. 8E is an end elevational view showing the rib-cam-beam assembly with the shelf skin attached over both edges of the rib.

With reference now to FIGS. 8A-8B, the shelf skin 18 is attached to a plurality of ribs 12 which have been secured to beam 16 by fitting a first one of the curled side edges 68 of the shelf skin 18 against and around an array of retaining ends 20 on one side of the ribs 12. The shelf skin 18 is then lowered over the ribs 12 bringing its second side edge 68 into contact with the array of retaining ends 20 on the other side of the ribs 12 as shown in FIGS. 8C-8D. Then, preferably using a padded squeezing tool to avoid marring the top surface 62 of the shelf skin 18 (see close-up in FIG. 8D), the second curled side edge 68 is snap-fitted over the retaining ends 20 (see close-up in FIG. 8E) to laterally secure the shelf skin 18 on the plurality of underlaying ribs 12 and causing the shelf skin 18 to lay generally flush against the top surfaces 22 of the array of supporting ribs 12 as shown in FIG. 1. It will be readily apparent that a shelf 18 may be constructed of any length using the invention.

The shelf assembly 10 described above is highly customizable in that it may be constructed using a varying number of underlying ribs 12 according to the intended length and weight load; the ribs 12 may be adjusted easily along the length of the beams 16; and the assembly 10 creates a very rigid, strong and secure shelving structure using a few parts which are easily assembled or disassembled.

There have thus been described certain embodiments of a shelf assembly for customizable furniture. While preferred embodiments have been described and disclosed, it will be recognized by those with skill in the art that modifications are within the true spirit and scope of the invention. The appended claims are intended to cover all such modifications.

We claim:

1. An adjustable shelf assembly comprising:

at least one rib cam having a longitudinal axis and a slot including a floor disposed perpendicularly to said longitudinal axis, at least one rib having a flat top retaining surface, a generally T-shaped downwardly opening aperture, and two inwardly extending opposing rib cam flanges, said aperture having an upper portion and a lower portion, said upper portion having two opposing upper recesses and an upper edge extending between said recesses, said lower portion bounded laterally by said rib cam flanges, said rib cam flanges each having an arced inner edge, said arced inner edge having upper and lower portions and a middle portion between said upper and lower portions, a support beam having a substantially I-shaped profile, two upper beam flanges, two lower beam flanges, an upper beam flange face, and two outwardly facing annular channels, each channel having a concave surface, said upper beam flanges of said beam slidably received in said upper recesses of said aperture and said upper beam flange face of said support beam in sliding engagement with said upper edge of said aperture such that said rib is captured on said beam, each of said rib cam flanges extending into a respective one of said channels, said arced inner edges of said rib cam flanges and said concave surfaces of said annular channels forming crescent-shaped profiles, the distance between said inner edge of said rib cam flanges and said concave surface of said annular channels being greater at said middle portion than at said upper or lower portions, said rib cam rotatably received in one of said channels with one of said rib cam flanges captured in said slot and said floor of said slot in abutting engagement with said arced inner edge of said rib cam flange, one of said upper beam flanges disposed adjacent to said rib cam, said rib cam rotatable around said longitudinal axis between an unlocked position and a locked position, in said unlocked position said floor of said slot tangentially abutting said middle region of said inner edge of said rib cam flange, said rib cam being slidable in one of said annular channels along said beam, and said rib being slidable longitudinally along said beam, and in said locked position said floor abutting one of said upper and lower portions of said inner edge of said rib cam flange thereby tightening said floor against said inner edge of said rib cam flange, thereby pressing said upper edge of said upper portion of said aperture against said upper beam flange face of said support beam, and biasing said adjacently disposed upper beam flange into one of said upper recesses of said aperture of said rib, such that said rib cam is fixed in said annular channel, and said rib is secured in place on said beam.

* * * * *